US006418995B1

(12) United States Patent
Sadrakula et al.

(10) Patent No.: US 6,418,995 B1
(45) Date of Patent: Jul. 16, 2002

(54) SHEET MATERIAL DISPENSER WITH SAFER SHEET CUTTING MEANS

(75) Inventors: Philip V. Sadrakula, Hudson, WI (US); Leonard Kampa, Bloomington; James F. Pitzen, Maplewood, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/531,929

(22) Filed: Mar. 21, 2000

Related U.S. Application Data

(63) Continuation-in-part of application No. 08/855,687, filed on May 14, 1997, now Pat. No. 6,039,102.

(51) Int. Cl.[7] ..... B32B 31/00

(52) U.S. Cl. ..... 156/510; 156/523; 156/577; 156/579; 225/20; 225/72; 225/91

(58) Field of Search ..... 156/510, 523, 156/577, 579; 225/20, 72, 91

(56) References Cited

U.S. PATENT DOCUMENTS

| | | | | |
|---|---|---|---|---|
| 1,299,087 | A | 4/1919 | Winterhalter | 225/15 |
| 4,119,251 | A | 10/1978 | Golner et al. | 225/20 |
| 4,427,144 | A | 1/1984 | Macgrory et al. | 225/7 |
| 4,516,711 | A | 5/1985 | Barege | 225/20 |
| 4,586,639 | A | 5/1986 | Ruff et al. | 225/1 |
| 4,651,911 | A | 3/1987 | Kirkup et al. | 225/20 |
| 4,762,586 | A | 8/1988 | Wilkie | 156/527 |
| 4,906,021 | A | 3/1990 | Rowe et al. | 280/784 |
| 4,944,441 | A | 7/1990 | Gana | 225/16 |
| 4,972,984 | A | 11/1990 | Frank et al. | 225/20 |
| 5,024,362 | A | 6/1991 | Karlsson | 225/20 |
| 5,161,723 | A | 11/1992 | Wirtz-Odenthal | 225/14 |
| 5,190,199 | A | 3/1993 | Bulger et al. | 225/1 |
| 5,275,073 | A | 1/1994 | Zemlak et al. | 83/171 |
| 5,393,367 | A | 2/1995 | Yu Chen | 152/523 |
| 5,791,586 | A | 8/1998 | Cayford et al. | 242/571.4 |

FOREIGN PATENT DOCUMENTS

| | | |
|---|---|---|
| EP | 0 279 920 | 8/1988 |
| GB | 2 173 141 | 10/1986 |
| GB | 2 196 285 | 4/1988 |
| GB | 2 255 925 | 11/1992 |
| WO | WO 89/00394 | 1/1989 |

OTHER PUBLICATIONS

European Patent Office, Patent Abstracts of Japan, abstract for JP 60213661, published Oct. 25, 1985, Applicant Hiuga Kozaburo.

*Primary Examiner*—Linda Gray
(74) *Attorney, Agent, or Firm*—William L. Huebsch

(57) ABSTRACT

A dispenser from which sheet material may be manually pulled from a supply of the sheet material carried on the dispenser through a passageway defined by a frame of the dispenser. The dispenser includes a cutting member having a sharp cutting edge adapted for transversely cutting the sheet material and an elongate contact surface generally parallel to and spaced from the cutting edge. The cutting member is mounted on the frame for movement between (1) a retracted position to which it is biased at which the cutting edge is positioned to restrict contact between a person using the dispenser and the cutting edge and at which the contact surface extends along the one side of the passageway—and (2) a cutting position to which the cutting member can be moved from its retracted position by manually tensioning sheet material being pulled from the dispenser around the contact surface of the cutting member. At the cutting position the cutting edge is positioned to intersect and transversely sever the tensioned sheet material being manually withdrawn from the dispenser.

11 Claims, 7 Drawing Sheets

SHEET MATERIAL DISPENSER WITH SAFER SHEET CUTTING MEANS

RELATED APPLICATION

This application is a continuation in part of U.S. patent application Ser. No. 08/855,687 filed May 14, 1997, which issued as U.S. Pat. No. 6,039,102 on Mar. 21, 2000.

FIELD OF THE INVENTION

The present invention relates to dispensers with which lengths of sheet materials may be manually dispensed from supplies of the sheet materials carried on the dispensers, which dispensers include cutting members having sharp cutting edges adapted for transversely cutting dispensed lengths of the sheet materials from the sheet materials remaining on the dispensers, and include means for protecting users of the dispensers from contact with the sharp cutting edges between their uses to cut the sheet materials.

DESCRIPTION OF THE RELATED ART

The art is replete with dispensers with which lengths of sheet materials may be manually dispensed from supplies of the sheet materials (typically in helical rolls) that are carried on the dispensers, which dispensers include cutting members having sharp cutting edges adapted for transversely cutting dispensed lengths of the sheet materials from the supply of sheet materials remaining on the dispensers. U.S. Pat. Nos. 3,567,557, and 4,915,768 provide illustrative examples. The cutting members on some of those dispensers provide a potential source of injury for persons using the dispensers, particularly if the cutting members have sharp teeth such as those on a cutting blade described in U.S. Pat. No. 4,913,767 that is adapted to cut folded polymeric sheet material. A guard described in U.S. Pat. No. 4,989,769 has been devised for such a cutting member, however, such guards can be removed by workmen that are less concerned with safety than with the ease of using the dispenser. Other such dispensers including means for protecting users of the dispensers from contact with the sharp cutting edges between their uses to cut the sheet materials are described in GB 2 173 141 A (A. E. Brown) dated Oct. 8, 1986; Patent Abstracts of Japan, vol. 010, no. 070 (M-462), dated Mar. 19, 1986, and JP 60 213661 A (Kouzaburou Hiuga), dated Oct. 25, 1985; and GB 2 196 285 A (S. Urushizaki) dated Apr. 27, 1988.

SUMMARY OF THE INVENTION

The present invention provides means useful on portable dispensers for transversely cutting dispensed lengths of sheet materials from supplies of the sheet materials carried on the dispensers, which means for transversely cutting protects a user of one of the dispensers from a cutting member on the dispenser between its uses to cut sheet material, while providing easy efficient severing of the sheet materials when that is desired.

According to the present invention there is provided a portable dispenser from which sheet material may be manually dispensed from a helically wound roll of the sheet material carried on the dispenser. A frame of the dispenser includes frame members defining a passageway through which sheet material being dispensed from the roll of sheet material can be pulled, which frame members include a first frame member having a guide surface generally parallel to an axis about which the sheet material is mounted for rotation. The dispenser includes a cutting member having a sharp cutting edge adapted for transversely cutting the sheet material. That cutting member also has an elongate contact surface generally parallel to and spaced from the cutting edge. The cutting member is mounted on the frame for pivotal movement relative to the frame about a cutting member pivot axis generally parallel to the sheet material axis, spaced from the guide surface of the frame, and generally parallel to and spaced from both the contact surface and the cutting edge of the cutting member. That pivotal movement is between:

a) a retracted position (to which the cutting member is biased) at which the cutting edge is spaced from the passageway and is positioned to restrict contact between a person using the dispenser and the cutting edge, and at which retracted position the contact surface of the cutting member projects away from the dispenser at a position spaced away from the first side of the passageway so that the sheet material will normally not contact it as the sheet material is puled from the dispenser and the sheet material must be tensioned in an arcuate path around the contact surface of the fame and the contact surface of the cutting member to move the cutting member, and b) a cutting position to which the cutting member can be moved from its retracted position by manually tensioning sheet material being pulled from the dispenser in an arcuate path around the guide surface of the frame and the contact surface of the cutting member, at which cutting position the cutting edge is positioned to transversely sever the sheet material tensioned between the guide surface of the frame and the contact surface of the cutting member.

The cutting member can have first and second portions with joined edges and with the cutting member pivot axis generally along their joined edges; the cutting edge being along the edge of its first portion opposite its second portion, and the contact surface being along the edge of its second portion opposite its first portion, and the cutting member being mounted on the first frame member with its cutting edge positioned along that first frame member and projecting toward the guide surface of the frame. The first and second portions of the cutting member can be disposed to provide a generally L-shaped cross section or can be disposed generally on opposite sides of the cutting member pivot axis.

BRIEF DESCRIPTION OF THE DRAWING

The present invention will be further described with reference to the accompanying drawing wherein like reference numerals refer to like parts in the several views, and wherein:

FIGS. 2 and 3 are enlarged end views of the first embodiment of the sheet cutting means according to the present invention on a fragment of the dispenser of FIG. 1 in which FIG. 2 illustrates a cutting member of the sheet cutting means in a normal retracted position, and FIG. 3 illustrates the cutting member in a cutting position so that illustrated sheet material 28 can be cut;

FIGS. 5 and 6 are enlarged end views of the sheet cutting means on a fragment of the dispenser of FIG. 4 in which FIG. 5 illustrates a cutting member of the sheet cutting means in a normal retracted position, and FIG. 6 illustrates the cutting member in a cutting position so that illustrated sheet material 61 can be cut;

FIGS. 7 and 8 are schematic cross sectional views of a third embodiment of a dispenser including sheet cutting means according to the present invention in which FIG. 7 illustrates a cutting member of the sheet cutting means in a normal retracted position, and FIG. 8 illustrates the cutting member in a cutting position so that illustrated sheet material 110 can be cut;

FIGS. 9 and 10 are enlarged fragmentary end views of a fourth embodiment of a dispenser including sheet cutting means according to the present invention in which FIG. 9 illustrates a cutting member of the sheet cutting means in a normal retracted position, and FIG. 10 illustrates the cutting member in a cutting position so that illustrated sheet material 28 can be cut;

DETAILED DESCRIPTION

Figure 1:
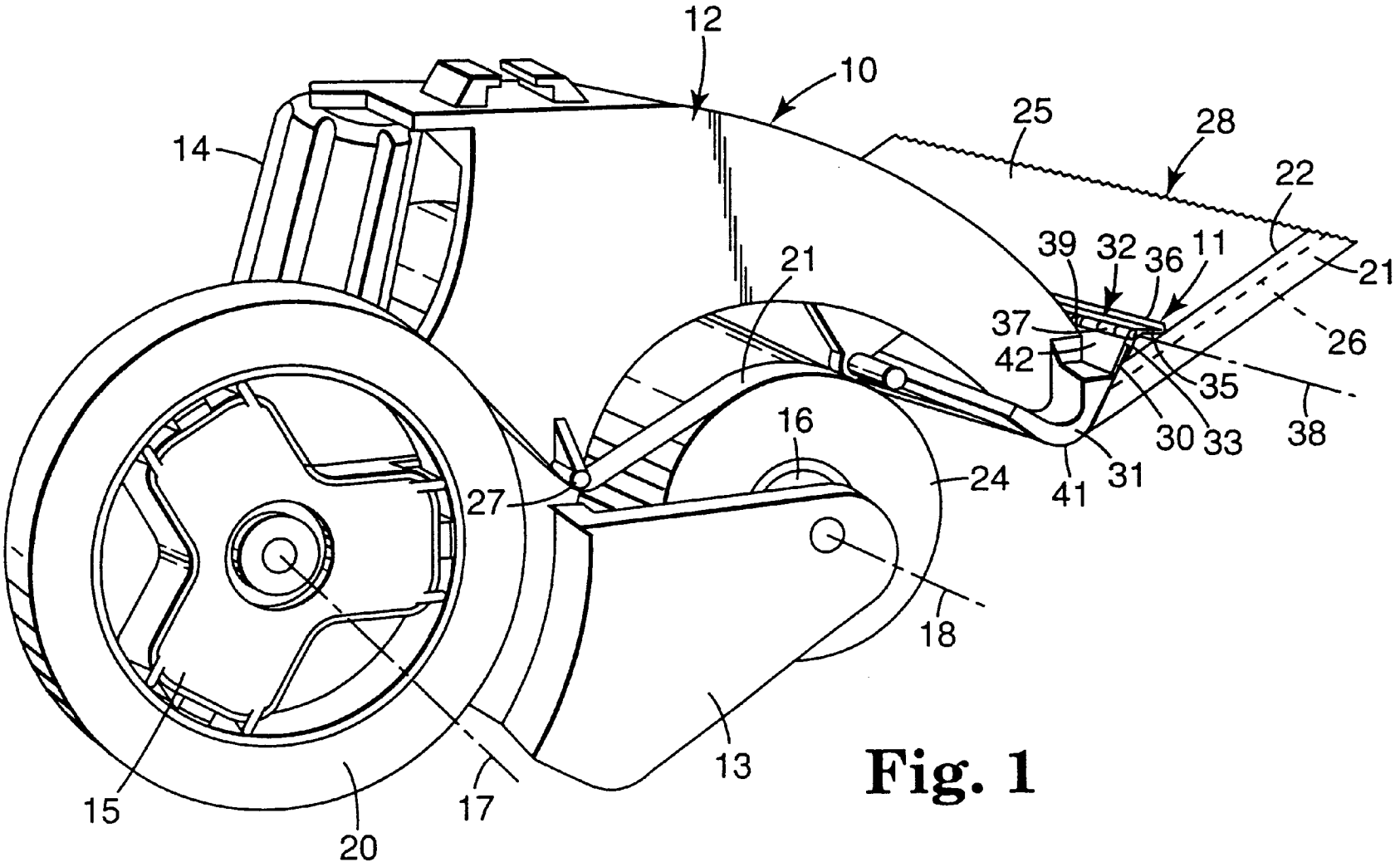
FIG. 1 is a perspective view of a first embodiment of a dispenser including sheet cutting means according to the present invention.
Figure 2:
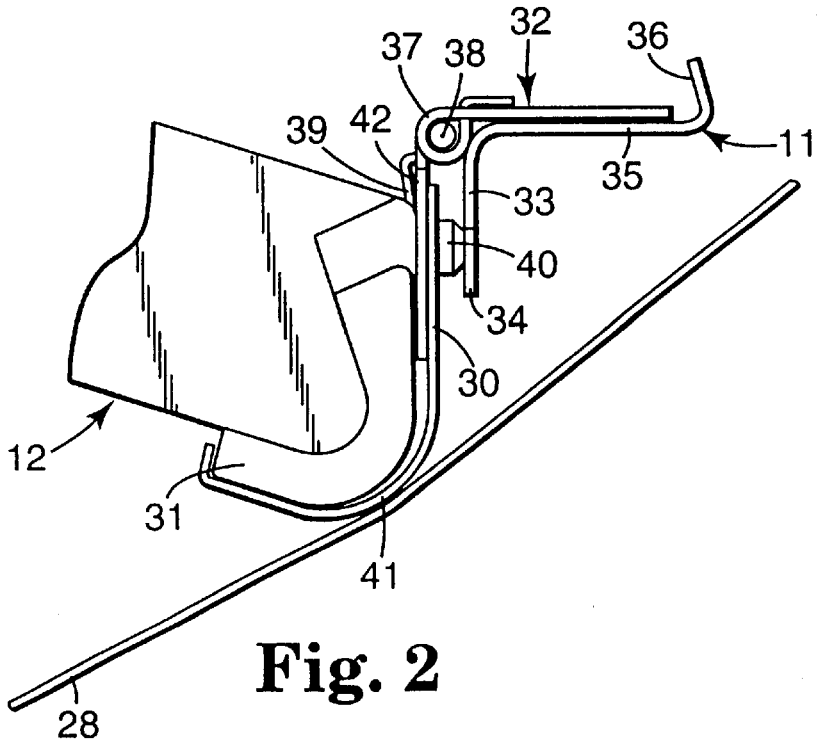
Figure 3:
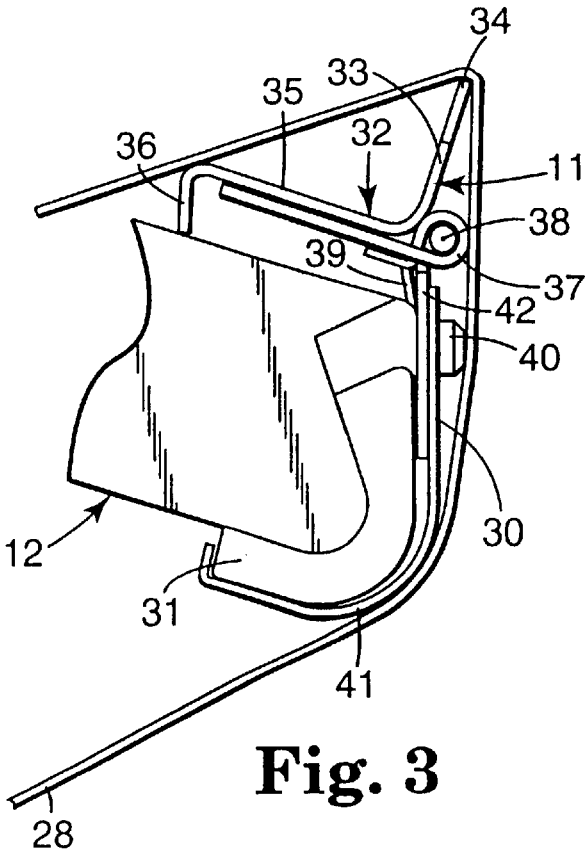

Referring now to FIGS. 1, 2 and 3 of the drawing, there is shown a dispenser 10 including sheet severing means 11 according to the present invention. Most of the dispenser 10 (except for the sheet severing means 11) is the same as corresponding parts of a dispenser called a masking machine or device that is described in U.S. Pat. No. 4,990,214 (the content whereof is incorporated herein by reference), one embodiment of which is sold by Minnesota Mining and Manufacturing Company, St. Paul, Minn. under the trade designation HAND-MASKER(™) M3X III Dispenser. Generally, that dispenser 10 includes a frame 12 comprising a polymeric portion including a hub support frame member 13 and a handle 14 adopted for manual engagement to manipulate the dispenser 10. First and second hubs 15 and 16 are mounted on the hub support frame member 13 for rotation about spaced generally parallel axes 17 and 18. The first hub 15 includes means for receiving a roll 20 of tape 21 and positioning a first edge 22 of a length of the tape 21 withdrawn from the roll 20 at a first predetermined position axially with respect to the first and second hubs 15 and 16 with the opposite second edge of that withdrawn length of tape 21 projecting past the frame 12. The second hub 16 is adapted to receive a roll 24 of masking material 25 and to position a first edge 26 of the length of masking material 25 at a second predetermined position axially with respect to the first and second hubs 15 and 16 with the width of the length of tape 21 extending from the first position past the second position and the width of the length of masking material 25 extending from the second position past the first position. A portion of the length of tape 21 along the first edge 22 of the length of tape and a portion of the length of masking material 25 along the first edge 26 of the length of masking material 25 are both positioned between those first and second positions. The dispenser 10 includes means including a guide pin 27 that defines a path for the length of tape 21 from the roll 20 of tape 21 to the periphery of the roll 24 of masking material 25 where the portion of tape 21 along the first edge 22 of the length of tape 21 is adhered to the portion of the masking material 25 along the first edge 26 of the length of masking material 25. Such adhesion of the tape 21 to the masking material 25 along the periphery of the roll 24 of masking material 25 forms a composite masking sheet material 28 having opposite edges defined by the second edges of the length of tape 21 and the length of masking material 25 and an exposed portion of the coating of pressure sensitive adhesive along the second edge on the length of tape 21 along one major surface of the composite masking sheet material 28 so that the exposed portion of the coating of adhesive can be adhered along a surface to be masked to hold the composite masking sheet 28 in a desired position.

The frame 12 defines a passageway on the device 10 through which a person may pull the composite masking sheet material 28 from the supply of composite masking sheet material 28 formed at the periphery of the roll 24. The frame is formed by members including a first elongate frame member 30 of sheet metal (e.g., 0.018 inch thick steel) that has a generally J-shaped cross section and is removably attached to another member 31 of the frame 12 included in the polymeric part thereof The first frame member 30 extends generally parallel to the axes 17 and 18 of the hubs 15 and 16 and defines a first side of the passageway. As is best seen in FIGS. 2 and 3, the dispenser 10 also includes an elongate cutting member 32 of sheet metal (e.g., also of 0.018 inch thick steel) that is generally L-shaped in cross section, has a blade portion 33 having a sharp cutting edge 34 adapted for transversely cutting the composite masking sheet material 28, and an activating portion 35 having an elongate contact surface 36 generally parallel to and spaced from the cutting edge 34. Means including a hinge assembly 37 (e.g., of the type called a "piano hinge") mounts the cutting member 32 on the first frame member 30 at the intersection of its blade and activating portions 33 and 35 for pivotal movement relative to the frame 12 about a cutting member pivot axis 38 generally parallel to and spaced from both the cutting edge 34, the contact surface 36, and the axes 17 and 18. That pivotal movement can be between (1) a retracted position illustrated in FIG. 2 to which the cutting member 32 is biased by spring means comprising two coil springs 39, and a cutting position illustrated in FIG. 3. In the retracted position (FIG. 2) the blade portion 33 and cutting edge 34 is along one of the side surfaces of the first frame member 30. That position of the cutting edge 34 restricts contact between the cutting edge 34 and a person using the dispenser 10. In the retracted position the contact surface 36 is spaced from and extends along the first side of the passageway defined by the first frame member 30. A user of the dispenser 10 can move the cutting member 32 from its retracted position to its cutting position by manually tensioning the composite masking sheet material 28 being pulled from the roll 24 around the contact surface 36 of the cutting member 32 (see FIG. 3). At that cutting position the blade portion 33 with its cutting edge 34 is spaced from the side surface of the first frame member 30 and the cutting edge 34 is positioned so that it will intersect and transversely sever the tensioned composite masking sheet material 28 as that composite masking sheet material 28 is pulled away from the dispenser 10 around the contact surface 36.

The first sheet metal frame member 30, the cutting member 32, and the hinge assembly 37 that mounts the cutting member 32 on the frame member 30 are an assembly that can be removed from the rest of the dispenser 10 in that the first sheet metal frame member 30 is removably attached to the frame member 31 by means described in U.S. Pat. No. 4,990,214. That attachment means briefly comprises one side of one end portion of the J-shaped elongate sheet metal frame member 30 being hooked around the member 31 of the polymeric part of the frame 12 that is adapted to fit in that end portion and being retained in that end portion by a pin 40 that projects from the member 31 through an opening in the first frame member 30. The first sheet metal frame member 30 can be removed from the member 31 by manually pressing on the frame member 30 so that it resiliently bends and flexes over the pin 40, whereupon the member 30 can be unhooked from the member 31.

The first frame member 30 comprises a guide portion 41 having an arcuate guide surface 29 generally parallel to the sheet material axis 18 that defines the first side of the passageway through which the composite masking sheet material 28 is withdrawn. The first frame member 30 also includes a support portion 42 projecting away from the guide portion 41 and the passageway on the side of the guide portion 41 opposite the axis 18 of the roll 24. The side surface of the first frame member 30 against which the cutting edge 34 is positioned in the retracted position of the cutting member 32 is on the side of the support portion 42 opposite the axis 18 of the roll 24. The cutting member pivot axis 38 is along the support portion 42 of the first frame member 30. The cutting member pivot axis 38, the cutting edge 34, and the contact surface 36 are disposed such that in the cutting position of the cutting member 32 (see FIG. 3) the tensioned composite masking sheet material 28 extends from the supply of composite masking sheet material 28 on the dispenser 10 to the contact surface 36 with the cutting edge 34 engaging the composite masking sheet material 28 between the supply of composite masking sheet material on the dispenser 10 and the contact surface 36, and the cutting member 32 engages the tensioned composite masking sheet material 28 only at the contact surface 36 and at the cutting edge 34 until further tension applied on the composite masking sheet material 28 to withdraw it will cause the cutting edge 34 to penetrate and ultimately sever the composite masking sheet material 28.

In the retracted position of the cutting member 32 (seen in FIGS. 1 and 2) the contact surface 36 extends along the first side of the passageway defined by the first frame member 30 at a position spaced away from the passageway so that the composite masking sheet material 28 will not normally contact the contact surface 36 as it is pulled from the dispenser 10 and must be tensioned in an arcuate path around both the guide surface 41 and the contact surface 36 to move the blade portion 33 of the cutting member 32 away from the axis 18 of the roll 24 to its cutting position (seen in FIG. 3) so that the cutting edge 34 will intersect and transversely sever masking sheet material 28 being pulled from the dispenser 10.

The cutting edge 34 can be provided by a plurality of similarly shaped teeth having generally the shapes of triangles along the opposite surfaces of the blade portion 33 of the cutting member 32, which teeth have bases aligned in a first direction longitudinally along the blade portion 33 with the points of the teeth projecting in the same direction away from the cutting member pivot axis 38. Those teeth, which are similar to the teeth described in U.S. Pat. No. 4,913,767 (the content whereof is incorporated herein by reference), can pierce the composite masking sheet material 28 when the cutting member 32 is moved to its cutting position, so that further tension applied on the composite masking sheet material 28 extending around the contact surface 36 will cause the teeth to further penetrate the composite masking sheet material 28 as a result of tension being applied to withdraw the composite masking sheet material 28 until the composite masking sheet material 28 is severed by the cutting edge 34 that extends along the teeth.

Optionally, the contact surface 36 could be coated with a material such as a rubber or adhesive that would provide good frictional engagement between the composite masking sheet material 28 and the surface 36 when the composite masking sheet material 28 is tensioned around the contact surface 36 to move the cutting member 32 to its cutting position.

Also, optionally the dispenser 10 could include a manually operable safety or retaining member, such as the L-shaped retaining member 47, that has a pivot portion mounted on the frame 12 for rotation about its longitudinal axis through an angle of about 90 degrees between (1) a safe position (FIG. 2) at which a projecting portion of the L-shaped retaining member 47 overlays the cutting member 32 in its retracted position to prevent it from being moved to its cutting position; and (2) a release position (FIG. 3) at which the projecting end portion of the L-shaped retaining member 47 is parallel with the axis 38 and spaced from the cutting member 32 so that the cutting member 32 can be used as described above to cut the composite masking sheet material 28.

Figure 4:
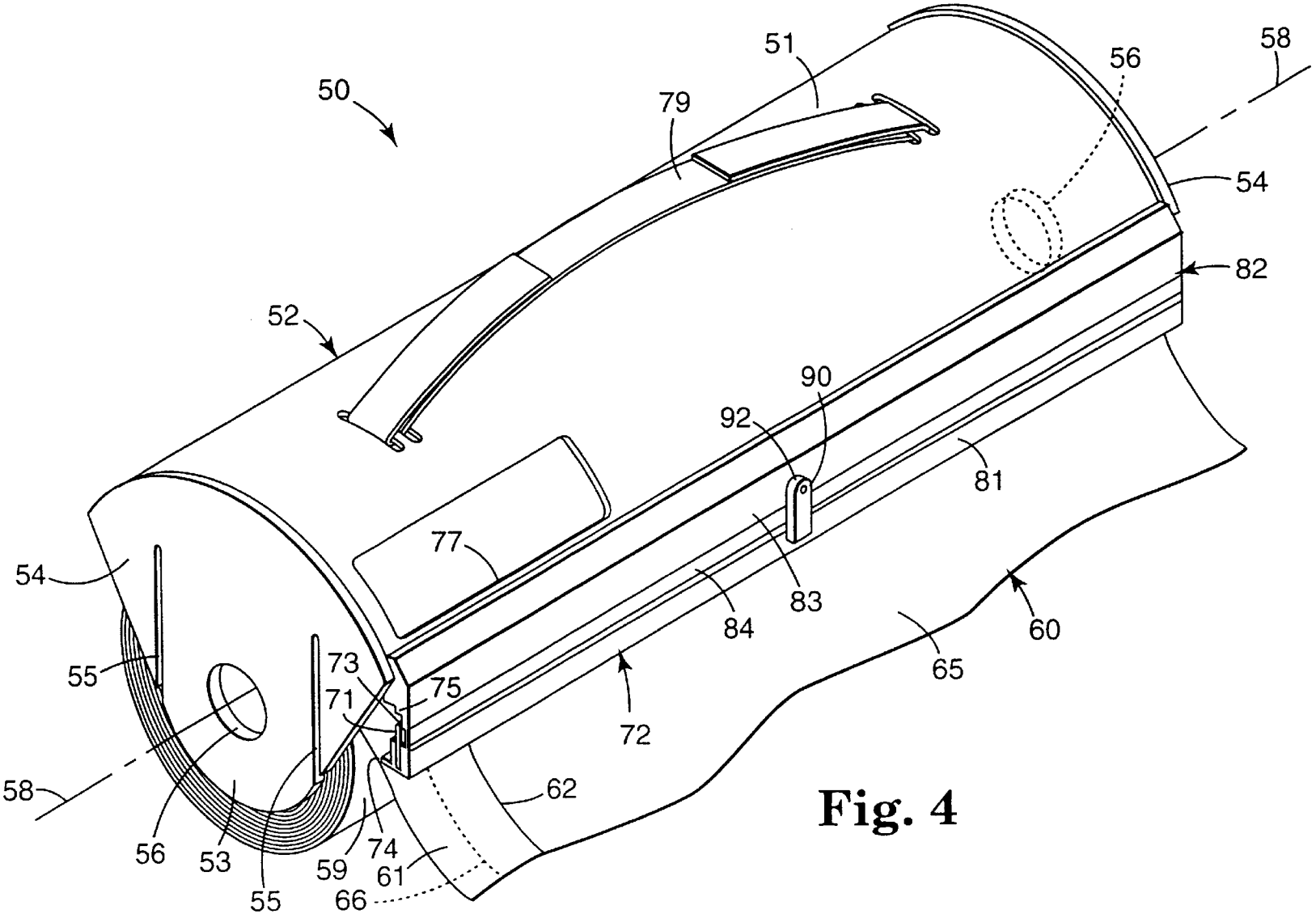
FIG. 4 is a perspective view of a second embodiment of a dispenser including sheet cutting means.
Figure 5:
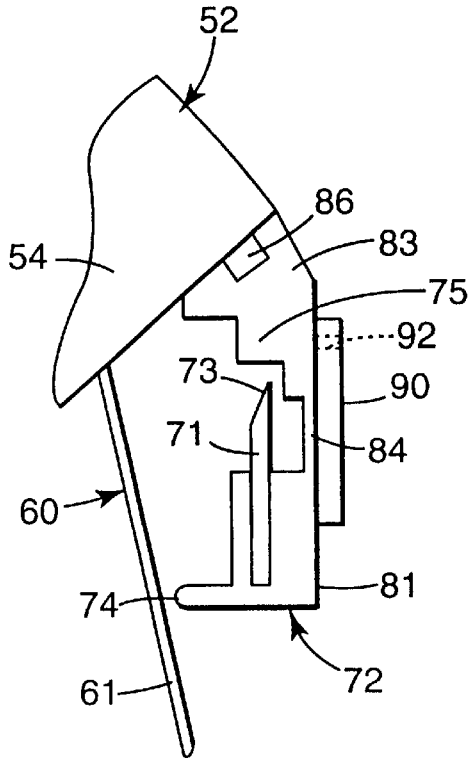
Figure 6:
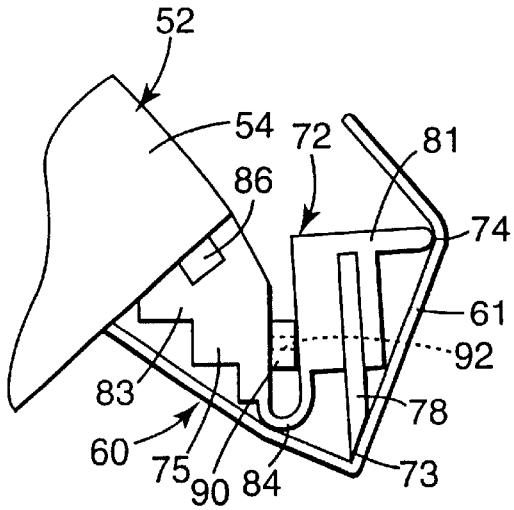

Referring now to FIGS. 4, 5, and 6 of the drawing, there is shown a dispenser 50 including sheet severing means. Generally, the dispenser 50 comprises a frame 52 made up of frame members including a semi-cylindrical frame member 51 that has an outer surface adapted for manual engagement to manipulate the dispenser 50, and parallel end wall frame members 54. Opposite ends of the semi-cylindrical frame member 51 are fixed as by an adhesive in opposed semi-circular grooves in the end wall frame members 54, and the end wall members 54 have spaced parallel slots 55 that define two spaced resiliently flexible hub support portions 53 at the opposite ends of the semi cylindrical frame member 51 Opposed cylindrical hubs 56 are fixed on the hub support portions 53 and are coaxial about an axis 58 that is also the axis of the semi-cylindrical member 51. The spaced hubs 56 are adapted for journaling opposite ends of the core in a supply roll 59 of composite masking sheet material 60 with the roll 59 in a cavity defined by inner surfaces of the frame 52. One or both of the hub support portions 53 can be resiliently flexed away from the other to afford inserting a roll 59 between or removing a core from the hubs 56. The composite masking sheet material 60 includes a length of tape 61 having a portion along a first edge 62 of the length of tape 61 adhered to a portion of a length of longitudinally folded polymeric film masking material 65 along a first edge 66 of the length of masking material 65 so that the composite masking sheet material 60 has opposite edges defined by second edges of the length of tape 61 and the length of masking material 65 opposite their first edges 62 and 66, and has an exposed portion of the coating of pressure sensitive adhesive along the second edge of the length of tape 61 along one major surface of the composite masking sheet material 60 so that the exposed portion of the coating of adhesive can be adhered along a surface to be masked to hold the composite masking sheet material 60 in a desired position.

The frame 52 defines a passageway through which a person may pull the composite masking sheet material 60 from the roll 59. The dispenser 50 includes a cutting member 72 including a blade 71 having a sharp cutting edge 73 (see FIG. 5) adapted for transversely cutting the composite masking sheet material 60. The cutting member 72 also includes an elongate contact surface 74 generally parallel to and spaced from the cutting edge 73. Means including hinge means (later to be explained) mounts the cutting member 72 on the frame 52 along a first side of the passageway for pivotal movement relative to the frame 52 about a cutting member pivot axis generally parallel to and spaced from the cutting edge 73, the contact surface 74 and the axis 58. That pivotal movement can be between (1) a retracted position illustrated in FIGS. 4 and 5 to which the cutting member 72 is biased by spring means (later to be explained), and (2) a cutting position illustrated in FIG. 6. In the retracted position the cutting edge 73 is spaced from the passageway and positioned along the inner surface of the frame 52 that defines the cavity for the roll 59, which position of the cutting edge 73 restricts contact between the cutting edge 73 and a person using the dispenser 50. The frame 52 includes a ledge 75 extending in closely spaced relationship along the sharp cutting edge 73 in a position adapted to further restrict contact with the sharp cutting edge 73 when the cutting member 72 is in its retracted position. In the retracted position of the cutting member 72 the contact surface 74 extends along the first side of the passageway defined by the frame 52. A user of the dispenser 50 can move the cutting member 72 from its retracted position to its cutting position by manually tensioning the composite masking sheet material 60 being pulled from the supply of the sheet material 60 in the dispenser 50 around the contact surface 74 of the cutting member 72. At that cutting position (see FIG. 6) the cutting edge 73 is along the first side of the passageway where it will intersect, pierce, and transversely sever the tensioned composite masking sheet material 60. Such tensioning of the composite masking sheet material 60 being pulled from the roll 59 around the contact surface 74 of the cutting member 72 is facilitated by an opening 77 through the arcuate frame member 51. A person holding the dispenser 50 with his or her right hand fingers projecting at generally a right angle to the axis 58 along the outer surface of the arcuate frame member 51 and beneath an adjustable length strap 79 having its ends attached at axially spaced positions along the frame member 51 with the palm of that hand on the side of the strap 79 adjacent the cutting member 72 can press his or her thumb through the opening 77 against the roll 59 to stop its rotation so that the person's other hand can pull on the composite masking sheet material 60 from the side of the cutting member 72 opposite the roll to cause the tension necessary to move the cutting member 72 from its retracted position (FIGS. 4 and 5) to its cutting position (FIG. 6) to then cut the composite masking sheet material 60 on the cutting edge 73.

The cutting member 72 comprises the elongate metal blade 71 on one side of which is the cutting edge 73, and a first part 81 of an elongate polymeric extrusion or member 82 that forms the contact surface 74, has a socket in which is fixed a side portion of the metal blade 71 opposite the cutting edge 73, and is joined by a thin section 84 of the polymeric extrusion 82 to a second attachment part 83 thereof which has an elongate slot that receives an edge portion 86 of the arcuate frame member 51. That edge portion 86 is attached to the attachment part 83 by means such as a suitable adhesive so that the attachment part 83 is a member of the frame 52. The thin section 84 of the polymeric extrusion provides both the hinge means (i.e., the hinge means being of the type often called a "living hinge") and, because of the resiliently flexible nature of the polymeric material, also provides the spring means for the cutting member 72. Alternatively, the arcuate frame member 51 could be extruded to include the polymeric extrusion 82 with the thin section 84 and the first part 81 that supports the blade 71 along its edge portion 86.

The elongate metal blade 71 is transversely corrugated along its length and has a ground planar surface along its length disposed at an angle to its side surfaces that forms the cutting edge 73 on a plurality of similarly shaped teeth generally in the shapes of triangles. Those teeth have bases aligned in a first direction longitudinally along the blade 71 with the points of the teeth projecting in the same direction. The points of the teeth can pierce the composite masking sheet material 60 when the cutting member 72 is moved away from the axis 58 to its cutting position, where the tensioned composite masking sheet material 60 extends from the supply of masking sheet material on the dispenser 50 to the contact surface 74 with the cutting edge 73 engaging the composite masking sheet material 60 between that supply of masking sheet material and the contact surface 74. The cutting member 72 engages the tensioned composite masking sheet material 60 only at the contact surface 74 and at the cutting edge 73 until further tension applied on the composite masking sheet material 60 to withdraw it will cause the teeth to further penetrate and ultimately sever the composite masking sheet material 60.

Optionally, the contact surface 74 could be made of (e.g., by co-extrusion) or coated with a material such as a rubber or an adhesive that would provide good frictional engagement between the composite masking sheet material 60 and the contact surface 74 when the composite masking sheet material 60 is tensioned around the contact surface 74 to move the cutting member 72 to its cutting position.

Also, optionally the dispenser 50 could include a manually operable safety or retaining member, such as the elongate safety or retaining member 90 that is mounted on the attachment part 83 of the extrusion 82 and is pivotable about an end pivotably mounted thereon at a pin 92 between a safe position (FIGS. 4 and 5) at which an end portion of the retaining member 90 opposite the pin 92 overlays the first part 81 of the extrusion 82 in the retracted position of the cutting member 72 to prevent it from being moved to its cutting position; and a release position (FIG. 6) at which the retaining member 90 is spaced from the first part 81 of the extrusion so that the cutting member 72 can be used as described above to cut the composite masking sheet material 60.

Figure 7:
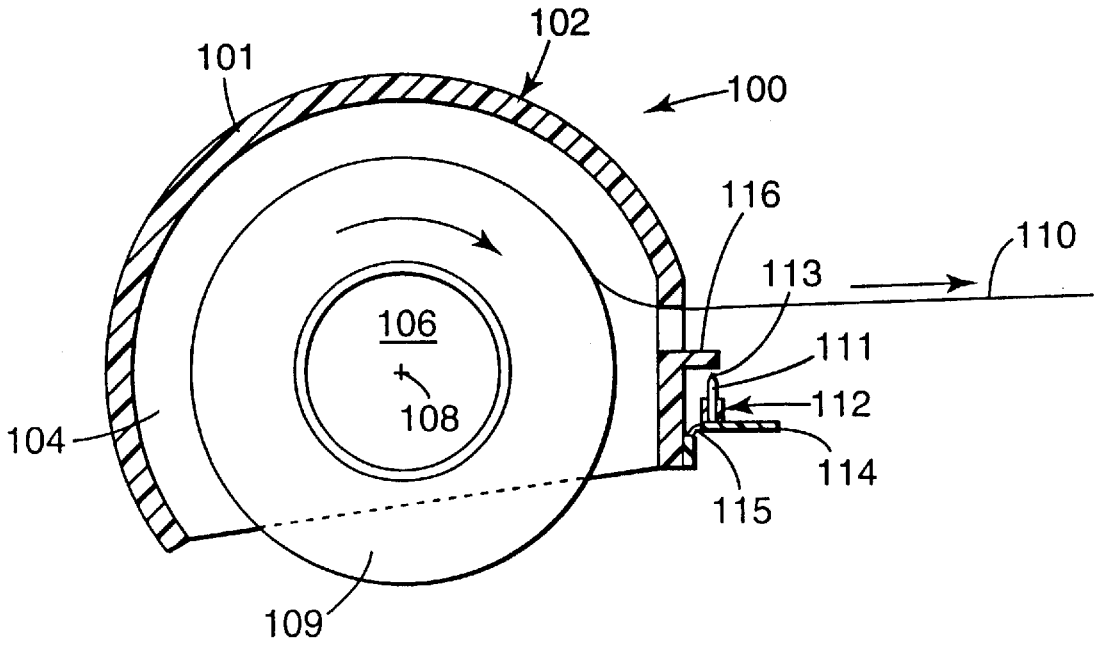
Figure 8:
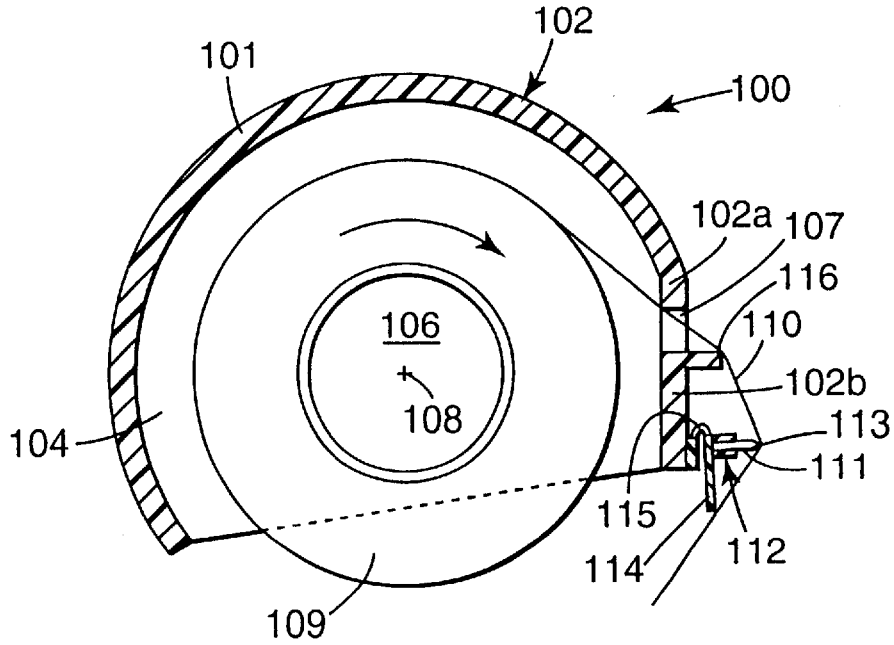

Referring now to FIGS. 7 and 8 of the drawing, there is shown a dispenser 100 according to the present invention including sheet severing means. Except for differences in the sheet severing means, the dispenser 100 could be similar to the dispenser 50 described above, and generally comprises a frame 102 made up of frame members including a semi-cylindrical frame member 101 that has an outer surface adapted for manual engagement to manipulate the dispenser 100, and parallel end wall frame members 104 (only one of which is shown) including spaced hubs 106 adapted for journaling opposite ends of the core in a supply roll 109 of sheet material 110 with the roll 109 in a cavity defined by inner surfaces of the frame 102 for rotation about an axis 108.

The frame 102 has closely spaced parts **102*a* and 102*b* that define a passageway 107 therebetween through which a person may pull the sheet material 110 from the roll 109. The dispenser 100 includes a cutting member 112 including a blade 111 having a sharp cutting edge 113 adapted for transversely cutting the sheet material 110. The cutting member 112*a* so includes an elongate contact surface 114 generally parallel to and spaced from the cutting edge 113. Means including hinge means in the form of a resiliently flexible strip 115 of polymeric material mounts the cutting member 112 on the part 102*b* of the frame 102 along a first side of the passageway 107 for pivotal movement relative to the frame 102 about a cutting member pivot axis generally parallel to and spaced from the cutting edge 113, the contact surface 114 and the axis 108. That pivotal movement can be between (1) a retracted position illustrated in FIG. 7 to which the cutting member 112 is biased by spring means provided by the resilient flexibility of the strip 115, and (2) a cutting position illustrated in FIG. 8. In the retracted position the cutting edge 113 is spaced from the passageway and positioned along the outer surface of the frame 102 adjacent a generally radially projecting ledge 116 on the frame 102 which restricts contact between a person using the dispenser 100 and the cutting edge 113. In the retracted position the contact surface 114 projects generally radially outwardly of the dispenser 100 along the first side of the passageway defined by the frame part 102***b* at a position spaced away from the passageway. A user of the dispenser 100 can move the cutting member 112 from its retracted position to its cutting position by manually tensioning the sheet material 110 being pulled from the supply of the sheet material 110 in the dispenser 100 in an arcuate path around the ledge 116 and the contact surface 114 of the cutting member 112. At that cutting position (see FIG. 8) the cutting edge 113 projects generally radially outwardly of the dispenser 100 along the first side of the passageway where it will intersect, pierce, and transversely sever the tensioned sheet material 110. Such tensioning of the sheet material 110 being pulled from the roll 109 around the ledge 116 and contact surface 114 of the cutting member 112 is facilitated by an opening (not shown) through the arcuate frame member 101. A person holding the dispenser 100 (as described above for the dispenser 50) can press his or her thumb through that opening against the roll 109 to stop its rotation so that the person's other hand can pull on the sheet material 110 from the side of the cutting member 112 opposite the roll 109 to cause the tension necessary to move the cutting member 112 from its retracted position (FIG. 7) to its cutting position (FIG. 8) to then cut the sheet material 110 on the cutting edge 113.

Figure 9:
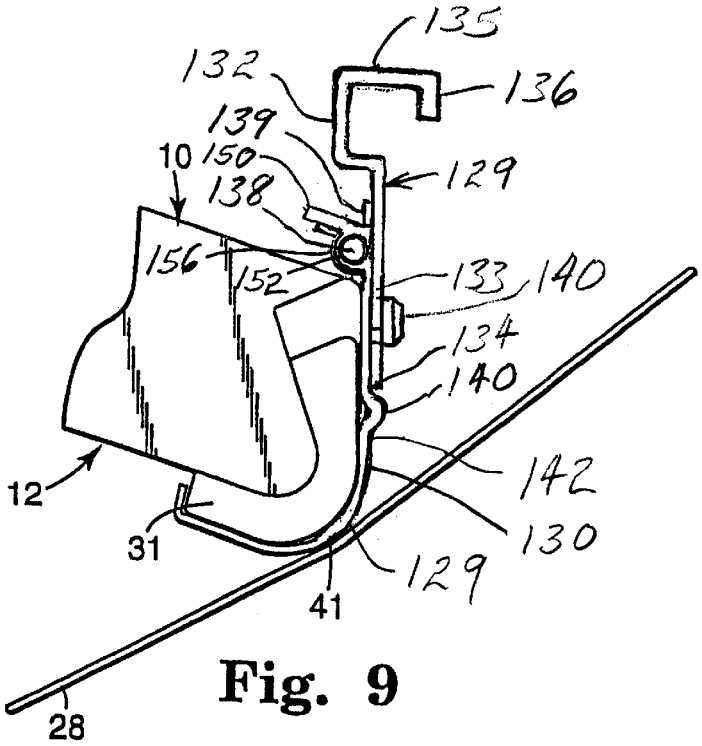
Figure 10:
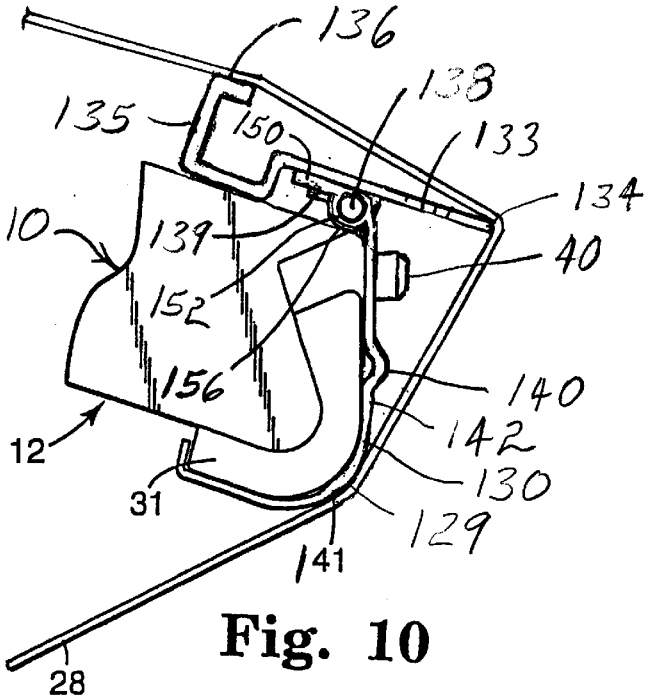

FIGS. 9 and 10 illustrate an assembly 129 including an elongate frame member 130 (illustrated seperately in FIGS. 13 and 14) and an elongate cutting member 132 (illustrated seperately in FIGS. 11 and 12) that can be used in place of the assembly including the first elongate frame member 30 and the elongate cutting member 32 of sheet metal included in the device 10 described above with reference to FIGS. 1, 2 and 3. As noted above, the frame 12 of that device 10 defines a passageway on the device 10 through which a person may pull the composite masking sheet material 28 from the supply of composite masking sheet material 28 formed at the periphery of the roll 24. That frame 12 is formed by members including the first elongate frame member 130 of sheet metal (e.g., 0.018 inch thick steel) that has a generally J-shaped cross section and is removeably attached to another member 31 of the frame 12 included in the polymeric part thereof The first frame member 130 extends generally parallel to the axes 17 and 18 of the hubs 15 and 16 and defines a first side of the passageway. The elongate cutting member 132 is also of sheet metal (e.g., of 0.015 inch thick steel) and has a blade portion 133 having a sharp cutting edge 134 adapted for transversely cutting the composite masking sheet material 28, and an activating portion 135 having an elongate contact surface 136 generally parallel to and spaced from the cutting edge 134, which blade and activating portions 133 and 135 are generally disposed on opposite sides of an axis 138 at their juncture defined by a rod about which the cutting member 132 is pivitably mounted on the first frame member 130 by mounting means described below. That cutting member pivot axis 138 is generally parallel to and spaced from both the cutting edge 134, the contact surface 136, and the axes 17 and 18. Pivotal movement of the cutting member 132 about that rod and axis 138 can be between (1) a retracted position illustrated in FIG. 9 to which the cutting member 132 is biased by spring means comprising two or three coil springs 139, and a cutting position illustrated in FIG. 10. In the retracted position (FIG. 9) the blade portion 133 and cutting edge 134 is along one of the side surfaces of the first frame member 130. That position of the cutting edge 134 restricts contact between the cutting edge 134 and a person using the dispenser 10. A ridge 140 is formed along the first frame member 130 a short distance from the cutting edge 134 to further restrict contact between the cutting edge 134 and a person when the cutting member 132 is in its retracted position. In the retracted position of the cutting member 132 the contact surface 136 is spaced from and extends along the first side of the passageway defined by the first frame member 130. A user of the dispenser 10 can move the cutting member 132 from its retracted position to its cutting position by manually tensioning the composite masking sheet material 28 being pulled from the roll 24 around the contact surface 136 of the cutting member 132. At that cutting position (see FIG. 10) the blade portion 133 with its cutting edge 134 is spaced from the side surface of the first frame member 130 and the cutting edge 134 is positioned so that it will intersect and transversely sever the tensioned composite masking sheet material 28 as that composite masking sheet material 28 is pulled away from the dispenser 10 around the contact surface 136.

Like the first sheet metal frame member 30 described above, the sheet metal frame member 130 is removeably attached to the frame member 31 by the means described in U.S. Pat. No. 4,990,214 which briefly comprises one side of one end portion the J-shaped elongate sheet metal frame member 130 being hooked around the member 31 of the polymeric part of the frame 12 that is adapted to fit in that end portion and being retained in that end portion by a pin 40 that projects from the member 31 through an opening in the first frame member 130. The first sheet metal frame member 130 can be removed from the member 31 by manually pressing on the frame member 130 so that it resiliently bends and flexes over the pin 40, whereupon the frame member 130 can be unhooked from the member 31.

The first frame member 130 comprises a guide portion 141 having an arcuate guide surface 129 generally parallel to the sheet material axis 18 that defines the first side of the passageway through which the composite masking sheet material 28 is withdrawn. The first frame member 130 also includes a support portion 142 projecting away from the guide portion 141 and the passageway on the side of the guide portion 141 opposite the axis 18 of the roll 24. The side surface of the first frame member 130 against which the cutting edge 134 is positioned in the retracted position of the cutting member 132 is on the side of the support portion 142 opposite the axis 18 of the roll 24. The cutting member pivot axis 138 is along the support portion 142 of the first frame member 130. The cutting member pivot axis 138, the cutting edge 134, and the contact surface 136 are disposed such that in the cutting position of the cutting member 132 (see FIG. 10) the tensioned composite masking sheet material 28 extends from the supply of composite masking sheet material 28 on the dispenser 10 to the contact surface 136 with the cutting edge 134 engaging the composite masking sheet material 28 between the supply of composite masking sheet material 28 on the dispenser 10 and the contact surface 136, and the cutting member 132 engages the tensioned composite masking sheet material 28 only at the contact surface 136 and at the cutting edge 134 until further tension applied on the composite masking sheet material 28 to withdraw it will cause the cutting edge 134 to penetrate and ultimately sever the composite masking sheet material 28.

In the retracted position of the cutting member 132 (seen in FIG. 9) the contact surface 136 extends along the first side of the passageway defined by the first frame member 130 at a position spaced away from the guide surface 129 and passageway so that the composite masking sheet material 28 will not normally contact the contact surface 136 as it is pulled from the dispenser 10. The composite masking sheet material 28 and must be tensioned in an arcuate path around both the guide surface 41 and the contact surface 136 to move the blade portion 133 of the cutting member 132 away from the axis 18 of the roll 24 to its cutting position (seen in FIG. 10) so that the cutting edge 134 will intersect and transversely sever masking sheet material 28 being pulled from the dispenser 10.

Figures 11, 12, 13, 14:
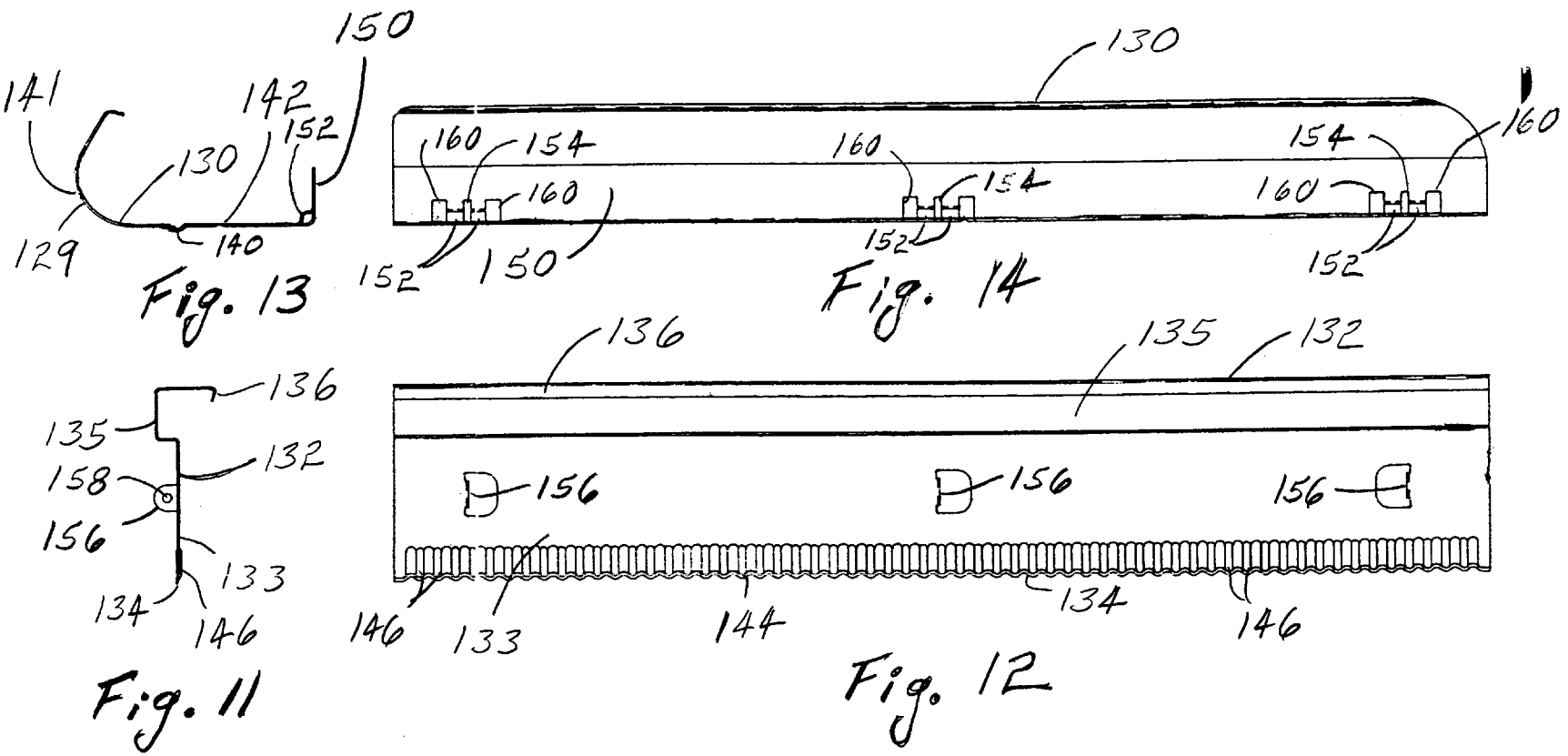
FIG. 11 is a reduced end view of the cutting member illustrated in FIGS. 9 and 10.
FIG. 12 is a side view of the cutting member illustrated in FIG. 11.
FIG. 13 is a reduced end view of a first elongate frame member illustrated in FIGS. 9 and 10.
FIG. 14 is a side view of the first elongate frame member illustrated in FIG. 13.

As is illustrated in FIG. 12, the blade portion 133 of the cutting member 132 can be transversely corrugated along its length and can have a ground planar surface 144 along its length disposed at an angle to its side surfaces that forms the cutting edge 134 on a plurality of similarly shaped teeth 146 generally in the shapes of triangles along the opposite surfaces of the blade portion 133 of the cutting member 132, which teeth 146 have bases aligned in a first direction longitudinally along the blade portion 133 with the points of the teeth 146 projecting in the same direction away from the cutting member pivot axis 138. Alternatively, those triangular teeth could be made and shaped like the teeth described in U.S. Pat. No. 4,913,767. Those triangular teeth 146 can pierce the composite masking sheet material 28 when the cutting member 132 is moved to its cutting position, so that further tension applied on the composite masking sheet material 28 extending around the contact surface 136 will cause the teeth 146 to further penetrate the composite masking sheet material 28 as a result of tension being applied to withdraw the composite masking sheet material 28 until the composite masking sheet material 28 is severed by the cutting edge 134.

The mounting means by which the cutting member 132 is mounted on the first frame member 130 for pivitol movement between its retracted and cutting positions includes the rod that defines the cutting member pivot axis 138, and a right angle bend between a distal portion 150 of the first frame member 130 and the support portion 142 of the first frame member 130 having the side surface along which the blade portion 133 is positioned in the retracted position of the cutting member 132. The rod is retained along the normally disposed inner surfaces formed by that bend by three pairs of spaced retaining portions 152 of the first frame member 130 (see FIGS. 13 and 14) that are bent away from those normal inner surfaces. Between each pair of retaining portions 152 is a slot 154 in the first frame member 130 into which project three tabs 156 bent at right angles to the major surfaces of the cutting member 132 at spaced intervals along its jucture between its blade portion 133 and its activating portion 135 (see FIGS. 13, 14, 15, and 16). The tabs 156 have central openings 158 that receive portions of the rod extending between the pairs of retaining portions 152. The first frame member 130 also has openings 160 flanking each pair of retaining portions 152 in some of which openings 160 are positioned the torsion springs 139 that bias the cutting member 132 to its retracted position. The distal portion 150 of the first frame member 130 provides a stop for the cutting member 132 when it is moved to its cutting position (see FIG. 10).

A significant difference between the assembly 129 including the elongate frame member 130 and the elongate cutting member 132 and the assembly including the first elongate frame member 30 and the elongate cutting member 32 included in the device 10 described above with reference to FIGS. 1, 2 and 3 is the different relative positioning of their sharp cutting edges 34 and 134 and their contact surfaces 36 and 136 with respect to their cutting member pivot axes 38 and 138. A first imaginary plane through the pivot axis 138 and the contact surface 136 would intersect a second imaginary plane through the pivot axis 138 and the cutting edge 134 at an angle of about 135 degrees, whereas a first imaginary plane through the pivot axis 38 and the contact surface 36 would intersect a second imaginary plane through the pivot axis 38 and the cutting edge 34 at an angle of about 82 degrees. That relative positioning of the sharp cutting edge on the blade portion and the contact surface on the activating portion with respect to the cutting member pivot axis can be changed to provide a desired angle of contact between the cutting edge and the sheet material 28 when the cutting member is moved to its cutting position. This desired angle of contact may differ depending on the type of cutting edge that is used and the type of sheet material to be cut. For the type of dispenser 10 described above, the ange between the palnes described above should generally be in the range of about 45 to 200 degrees, with a more preferred range being about 75 to 135 degrees.

Optionally, the contact surface 136 could be coated with a material such as a rubber or adhesive that would provide good frictional engagement between the composite masking sheet material 28 and the surface 136 when the composite masking sheet material 28 is tensioned around the contact surface 136 to move the cutting member 132 to its cutting position.

The present invention has now been described with reference to several embodiments thereof It will be apparent to those skilled in the art that many changes can be made in the embodiments described without departing from the scope of the present invention. For example, the sheet material can be a composite of two materials (i.e., adhesive coated tape and polymeric film) as described above with reference to the dispensers 10 and 50, or could be single sheets of any material such as paper, thin metal, cloth, polymeric material (e.g., film, shrink film, woven or non-woven fibers) or combinations thereof, which sheets may or may not be coated with a material such as pressure sensitive adhesive (i.e., adhesive tape) or an abrasive (i.e., sandpaper). Also, the cutting edge can be formed on spaced teeth as described above, or alternatively could be any other cutting edge, such as a straight sharp cutting edge of the type used on a razor blade. Thus, the scope of the present invention should not be limited to the structures and methods described in this application, but only by the structures and method described by the language of the claims and the equivalents thereof

What is claimed is:

1. A portable dispenser from which sheet material may be manually dispensed from a helically wound roll of the sheet material, said dispenser comprising:

a frame; and means on said frame mounting the roll of sheet material for rotation relative to the frame about a sheet material axis;

said frame including frame members defining a passageway through which passageway sheet material being dispensed from the roll of sheet material can be pulled, said frame members including a first frame member having a guide surface generally parallel to said sheet material axis;

said dispenser further comprising:

a cutting member having a sharp cutting edge adapted for transversely cutting the sheet material, said cutting member also having an elongate contact surface generally parallel to and spaced from said cutting edge, said contact surface being at a fixed location on said cutting member relative to said cutting edge;

means mounting said cutting member on said frame for movement relative to said frame about a cutting member pivot axis generally parallel to said sheet material axis, spaced from said guide surface of said frame, and generally parallel to and spaced from both said contact surface and said cutting edge of said cutting member, said movement being between:

a) a retracted position at which said cutting edge is spaced from said passageway and positioned to restrict contact between a person using the dispenser and said cutting edge, and at which retracted position said contact surface of said cutting member projects away from said dispenser at a position spaced away from said first side of said passageway so that said sheet material must be tensioned in an arcuate path around said guide surface of said fame and said contact surface of said cutting member to move said cutting member, and b) a cutting position to which the cutting member can be moved from said retracted position by manually tensioning sheet material being pulled from the dispenser in an arcuate path around said guide surface of said frame and said contact surface of the cutting member, at which cutting position said cutting edge is positioned to transversely sever the sheet material tensioned between said guide surface of said frame and said contact surface of said cutting member; and means for biasing said cutting member to said retracted position.

2. A dispenser according to claim 1 wherein said cutting member has first and second generally planar portions having joined edges with said cutting member pivot axis generally along said joined edges of said first and second generally planar portions, said cutting edge being along the edge of said first portion opposite said second portions and said contact surface of said cutting member being along the edge of said second portion opposite said first portion, said cutting member being mounted on said first frame member with said cutting edge positioned along said first frame member and projecting toward said guide surface of said frame.

3. A dispenser according to claim 2 wherein said first and second generally planar portions of said cutting member are disposed to provide a generally L-shaped cross section for said cutting member in a plane normal to said cutting member pivot axis.

4. A dispenser according to claim 2 wherein said first and second generally planar portions of said cutting member are disposed generally on opposite sides of said cutting member pivot axis from each other.

5. A dispenser according to claim 1 wherein said frame includes a ledge extending along said cutting edge in a position adapted to restrict contact with said cutting edge when said cutting member is in said retracted position.

6. A dispenser according to claim 1 wherein said first frame member is removably attached to other of said frame members.

7. A dispenser according to claim 1 wherein said cutting member includes a row of spaced projecting teeth adapted for piercing the sheet material and said cutting edge extends along said teeth to transversely cut the sheet material pierced by the teeth.

8. A dispenser according to claim 1 wherein a first imaginary plane through said pivot axis and said contact surface would intersect a second imaginary plane through the pivot axis and said cutting edge at an angle in the range of about 45 to 200 degrees.

9. A dispenser according to claim 1 wherein a first imaginary plane through said pivot axis and said contact surface would intersect a second imaginary plane through the pivot axis and said cutting edge at an angle in the range of about 75 to 135 degrees.

10. A dispenser according to claim 1 wherein a first imaginary plane through said pivot axis and said contact surface would intersect a second imaginary plane through the pivot axis and said cutting edge at an angle of about 135 degrees.

11. A dispenser according to claim 1 wherein a first imaginary plane through said pivot axis and said contact surface would intersect a second imaginary plane through the pivot axis and said cutting edge at an angle of about 90 degrees.

* * * * *